US012007197B1

(12) United States Patent
Rivers, Sr.

(10) Patent No.: US 12,007,197 B1
(45) Date of Patent: Jun. 11, 2024

(54) FIREARM STABILIZING APPARATUSES

(71) Applicant: Vernon L. Rivers, Sr., Fisher, LA (US)

(72) Inventor: Vernon L. Rivers, Sr., Fisher, LA (US)

( * ) Notice: Subject to any disclaimer, the term of this patent is extended or adjusted under 35 U.S.C. 154(b) by 0 days.

(21) Appl. No.: 18/224,190

(22) Filed: Jul. 20, 2023

(51) Int. Cl.
*F41C 27/22* (2006.01)

(52) U.S. Cl.
CPC ..... *F41C 27/22* (2013.01)

(58) Field of Classification Search
CPC ..... F41A 23/02; F41A 23/16; F41A 23/18; F41C 27/00; F41C 27/22
USPC ..... 42/94; 89/37.04; 216/64
See application file for complete search history.

(56) References Cited

U.S. PATENT DOCUMENTS 5,009,022 A * 4/1991 McCoy ..... F41C 33/001 42/106
D348,215 S * 6/1994 Melhorn ..... D8/367
5,685,103 A * 11/1997 Wiggins ..... F41A 23/18 248/230.8
5,723,808 A * 3/1998 Devall ..... F41A 23/06 89/37.04
5,806,508 A * 9/1998 Stempien ..... F41B 5/14 248/156
6,202,964 B1 * 3/2001 Thornhill ..... F16M 13/022 248/230.8
6,478,272 B1 * 11/2002 McKinsey ..... F16M 11/08 248/217.4
6,694,661 B1 * 2/2004 Langford ..... F41A 23/02 89/37.04
6,726,163 B2 4/2004 Eppard et al.
6,948,690 B1 * 9/2005 Sandel ..... F41B 5/14 89/37.04
8,087,195 B2 1/2012 Minges
8,316,572 B2 11/2012 Saunders, III
8,607,497 B2 * 12/2013 Green ..... A01K 87/00 248/230.8
8,683,909 B1 * 4/2014 Copus ..... F41A 23/16 182/127
9,328,992 B1 * 5/2016 Smith ..... F41C 33/001
9,593,903 B1 * 3/2017 Sanchez ..... F16M 13/02
10,928,151 B2 * 2/2021 Isch ..... F41A 23/16
2003/0038218 A1 * 2/2003 Eppard ..... F16M 11/2092 248/219.2

(Continued)

*Primary Examiner* — Joshua E Freeman
(74) *Attorney, Agent, or Firm* — R. Keith Harrison

(57) ABSTRACT

Firearm stabilizing apparatuses may include a device mounting assembly configured for securement to a support. A reel assembly may be supported by the device mounting assembly and configured for attachment to a firearm. The reel assembly may include a reel line configurable for extension and retraction within a vertical plane. The device mounting assembly may be configured to facilitate movement of the reel assembly within a horizontal plane when the device mounting assembly is secured to the support. The reel assembly may be selectively configurable in an adjustment mode and a locked mode. The reel assembly may be configured to selectively facilitate positional adjustment of the firearm within the vertical plane in the adjustment mode and securement of the firearm at a selected position within the vertical plane in the locked mode of the reel assembly when the device mounting assembly is secured to the support.

16 Claims, 9 Drawing Sheets

(56) References Cited

U.S. PATENT DOCUMENTS

| | | | | |
|---|---|---|---|---|
| 2005/0077443 | A1* | 4/2005 | Gillespie | A01M 31/00 248/216.1 |
| 2005/0246935 | A1* | 11/2005 | Northrup | F41A 23/02 42/94 |
| 2006/0137233 | A1* | 6/2006 | Meeks | F41C 33/001 42/94 |
| 2009/0064560 | A1* | 3/2009 | Saunders, III | F41C 33/001 42/94 |
| 2010/0018102 | A1* | 1/2010 | Minges | A47B 96/027 248/218.4 |
| 2010/0102184 | A1* | 4/2010 | Gorsuch | F41B 5/14 248/230.8 |
| 2011/0265367 | A1* | 11/2011 | Saunders, III | F41A 23/18 42/94 |
| 2011/0302819 | A1* | 12/2011 | McGhan | F41A 23/18 42/94 |
| 2013/0025178 | A1* | 1/2013 | Blitch | F41A 23/02 42/94 |
| 2015/0101233 | A1* | 4/2015 | Brown | F41A 23/16 42/94 |
| 2016/0178307 | A1* | 6/2016 | Johnson | F41C 33/001 414/800 |
| 2016/0195361 | A1* | 7/2016 | Barnett | F41G 11/003 42/90 |
| 2016/0309699 | A1* | 10/2016 | O'Donnell | F41C 33/001 |
| 2018/0335270 | A1* | 11/2018 | Smith | A01M 31/00 |
| 2019/0030945 | A1* | 1/2019 | Fox | B44D 3/38 |
| 2019/0045775 | A1* | 2/2019 | Brumbaugh | F16M 13/02 |
| 2022/0349669 | A1* | 11/2022 | Barnes | F41A 23/16 |
| 2023/0063925 | A1* | 3/2023 | Wynalda, Jr. | F16M 11/38 |

* cited by examiner

FIREARM STABILIZING APPARATUSES

FIELD

The present disclosure generally relates to firearms. More particularly, illustrative embodiments of the present disclosure relate to firearm stabilizing apparatuses which are suitable for stabilizing a firearm in a selected vertical aiming position while facilitating horizontal aim positioning.

SUMMARY

Illustrative embodiments of the disclosure are generally directed to firearm stabilizing apparatuses suitable for securement to a support to stabilize a firearm in a selected vertical aiming position while facilitating horizontal aim positioning of the firearm. An illustrative embodiment of the firearm stabilizing apparatuses may include a device mounting assembly configured for securement to the support. A reel assembly may be supported by the device mounting assembly and configured for attachment to the firearm. The reel assembly may include a reel line configurable for extension and retraction within a vertical plane. The device mounting assembly may be configured to facilitate movement of the reel assembly within a horizontal plane when the device mounting assembly is secured to the support. The reel assembly may be selectively configurable in an adjustment mode and a locked mode. The reel assembly may be configured to selectively facilitate positional adjustment of the firearm within the vertical plane in the adjustment mode and securement of the firearm at a selected position within the vertical plane in the locked mode of the reel assembly when the device mounting assembly is secured to the support.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
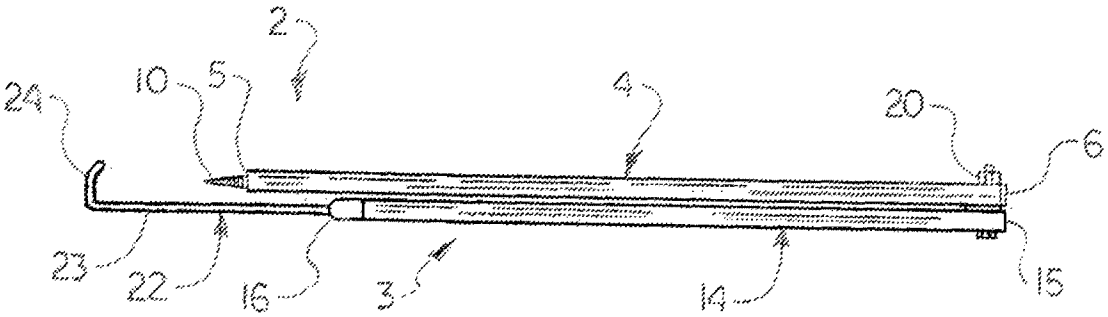
FIG. 4 is a side view of the anchor spike of the device mounting assembly in a folded configuration.
Figure 5:
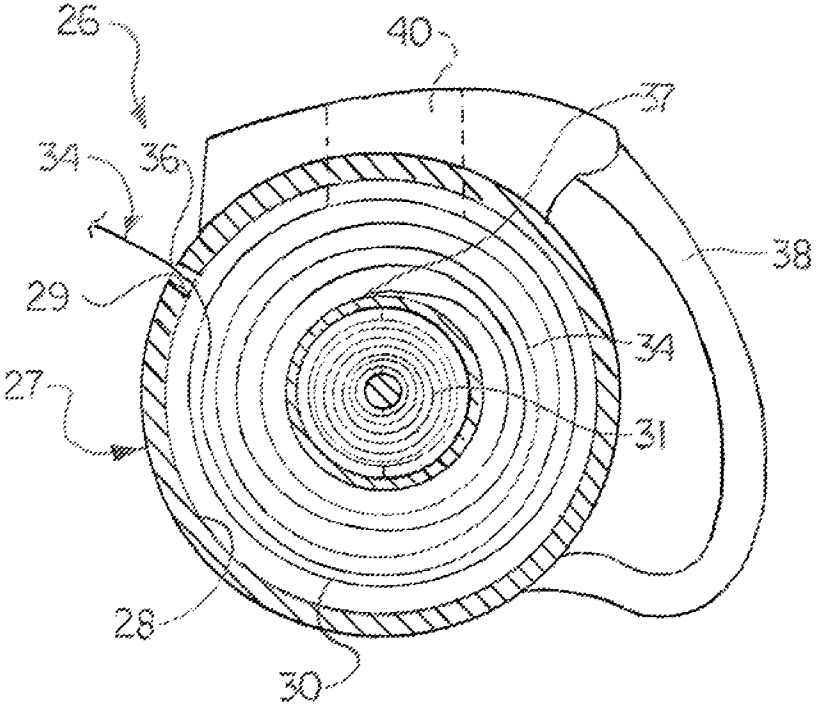
FIG. 5 is a sectional view illustrating typical interior components of an illustrative reel assembly of the firearm stabilizing apparatus illustrated in FIG. 1.
Figure 6:
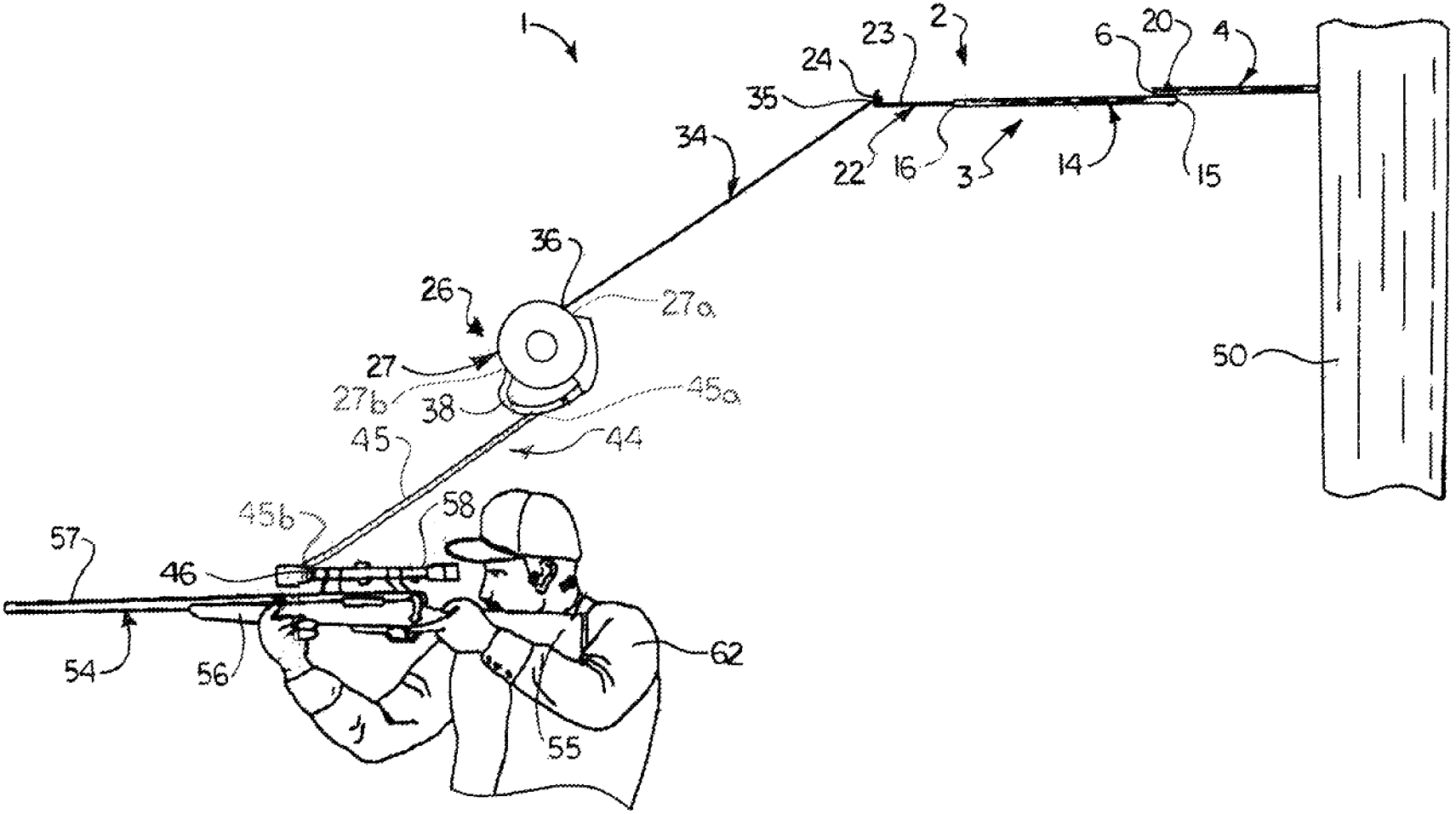
FIG. 6 is a left side view of the illustrative firearm stabilizing apparatus illustrated in FIG. 1, with the anchor spike of the device mounting assembly of the apparatus in the extended configuration and secured to a support, a firearm attached to the reel assembly of the apparatus, and a shooter aiming the firearm at a target (not illustrated) in typical application of the firearm stabilizing apparatus.

Referring initially to FIGS. 1-9 of the drawings, an illustrative embodiment of a firearm stabilizing apparatus is generally indicated by reference numeral 1. As illustrated in FIG. 6 and will be hereinafter described, the firearm stabilizing apparatus 1 may be suitable for securement to a support 50 to stabilize a firearm 54 such as a rifle in a selected vertical aiming position while enabling a shooter 62 to adjust the horizontal aiming position of the firearm 54. An illustrative embodiment of the firearm stabilizing apparatus 1 may include a device mounting assembly 2. The device mounting assembly 2 may be configured for securement to the support 50. A reel assembly 26 may be supported by the device mounting assembly 2. The reel assembly 26 may be configured for attachment to the firearm 54, such as in a manner which will be hereinafter described. The reel assembly 26 may include a reel line 34 which is configurable for extension and retraction within a vertical plane 66 (FIG. 7) to adjust the vertical aiming position of the firearm 54 to a selected aiming position within the vertical plane 66. The device mounting assembly 2 may be configured to simultaneously facilitate movement of the reel assembly 26 within a horizontal plane 68 (FIG. 2) to enable the shooter 62 to adjust the horizontal aiming position of the firearm 54. In typical application of the firearm stabilizing apparatus 1, the firearm 54 may be a rifle having a firearm stock 55, a forestock 56 extending from the firearm stock 55, a barrel 57 extending from the forestock 56, and a scope 58 on the forestock 56.

The reel assembly 26 may be selectively configurable in an adjustment mode and a locked mode. In the adjustment mode, the reel assembly 26 may be configured to selectively facilitate positional adjustment of the firearm 54 within the vertical plane 66 when the device mounting assembly 2 is secured to the support 50. In the locked mode, the reel assembly 26 may be configured to facilitate securement of the firearm 54 at the selected aiming position within the vertical plane 66.

Figure 7:
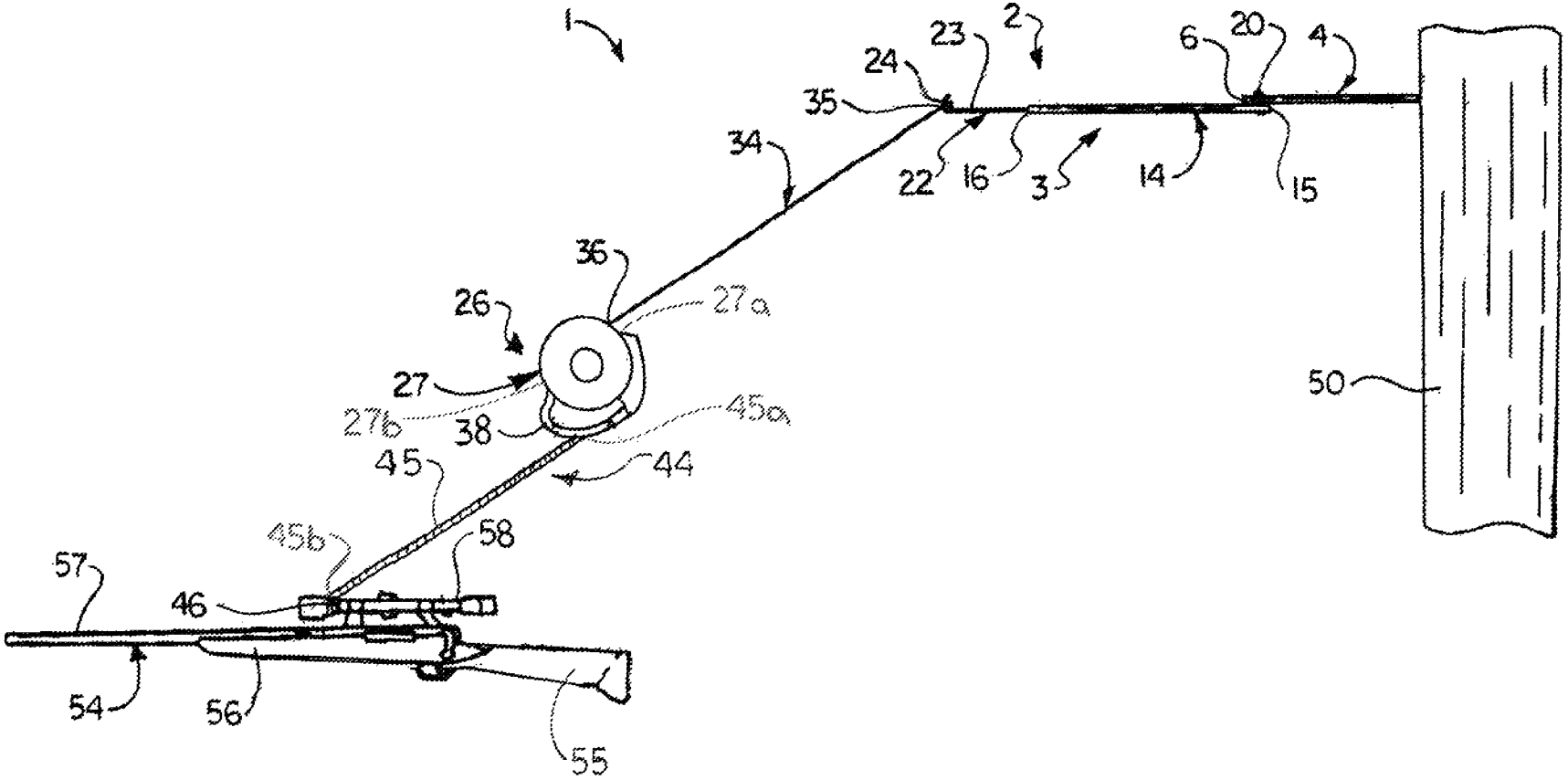
FIG. 7 is a side view of the illustrative firearm stabilizing apparatus, attached to the support (illustrated in phantom) as illustrated in FIG. 6, more particularly illustrating typical vertical aiming position adjustment of the firearm in typical application of the firearm stabilizing apparatus.

As used herein, "proximal" denotes the location or position of any component or the end of any component which is proximate to the support 50 relative to the firearm 54 in typical application of the firearm stabilizing apparatus 1, as illustrated in FIGS. 6 and 7. As used herein, "distal" denotes the location or position of any component or the end of any component which is proximate to the firearm 54 relative to the support 50 in typical application of the firearm stabilizing apparatus 1.

The support 50 may include any type of structure to which the device mounting assembly 2 is attachable for supporting the firearm stabilizing apparatus 1. For example and without limitation, in some applications, the support 50 may include a vertical structure such as a trunk of a tree or a utility pole.

In some embodiments of the firearm stabilizing apparatus 1, the reel line 34 of the reel assembly 26 may be attached to the device mounting assembly 2, as illustrated. A reel attachment device 44 may extend from the reel assembly 26. The reel attachment device 44 may be configured for attachment to the firearm 54. In other embodiments, the reel line 34 of the reel assembly 26 may be configured for attachment to the firearm 54. Accordingly, the reel attachment device 44 may be configured for attachment to the device mounting assembly 2.

The reel attachment device 44 may have any design or construction which is suitable to facilitate attachment of the reel assembly 26 to the firearm 54. For example and without limitation, in some embodiments, the reel attachment device 44 may include a reel tether 45. The reel tether 45 may have a first tether end 45*a* which is attached to the reel assembly 26 and a second tether end 45*b* which is opposite the first tether end 45*a* and configured for attachment to the firearm 54. The second tether end 45*b* may have a tether loop 46 which is configured for receiving the firearm 54. For example and without limitation, as illustrated in FIG. 6, in some applications, the tether loop 46 may be extended around the scope 58 of the firearm 54. In other applications, the tether loop 46 may be extended around the forestock 56, the barrel 57, or other component of the firearm 54. In other embodiments, the reel attachment device 44 may have alternative designs suitable for the purpose.

Figure 1:
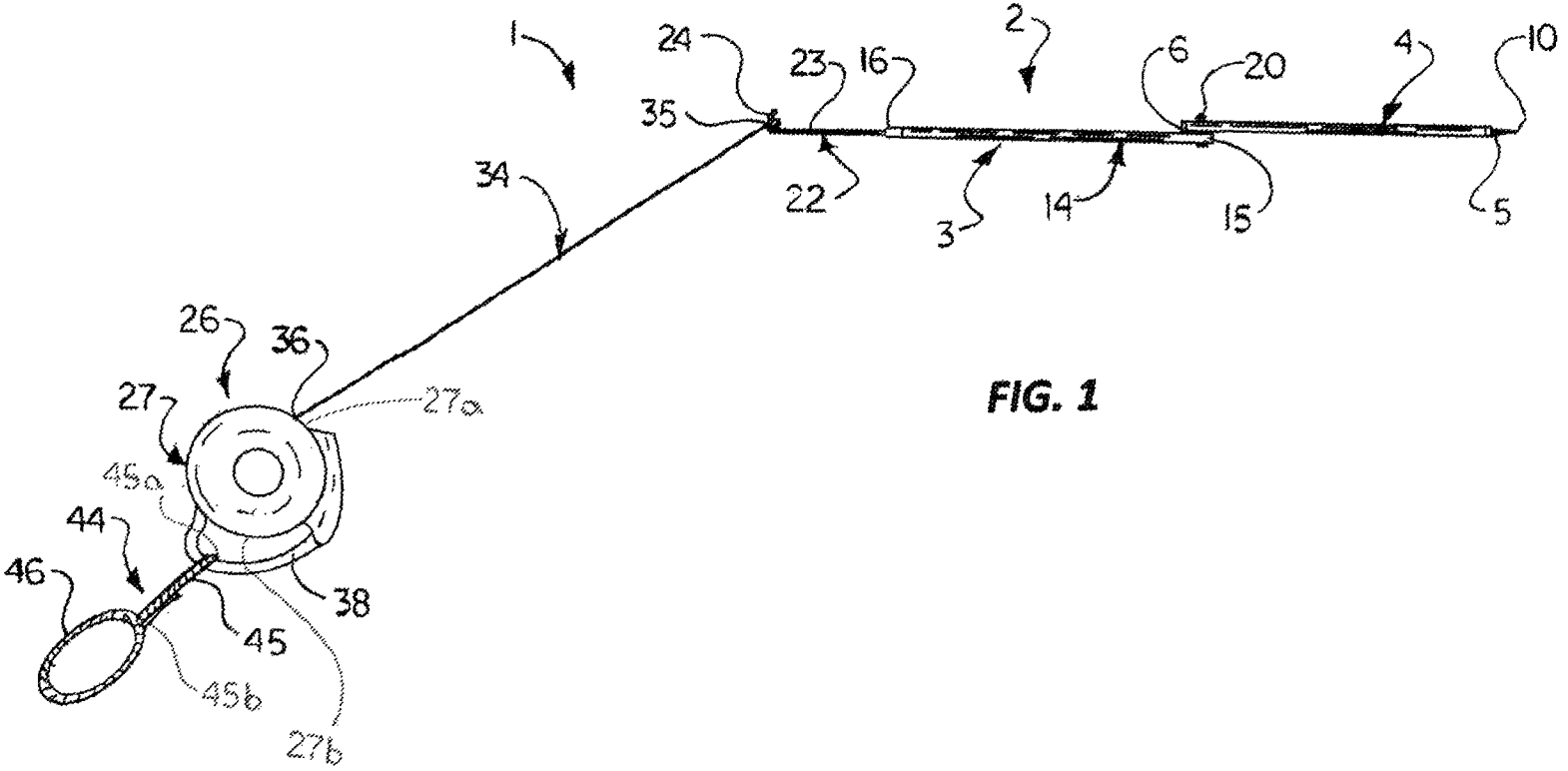
FIG. 1 is a left side view of an illustrative embodiment of the firearm stabilizing apparatuses of the disclosure.
Figure 2:
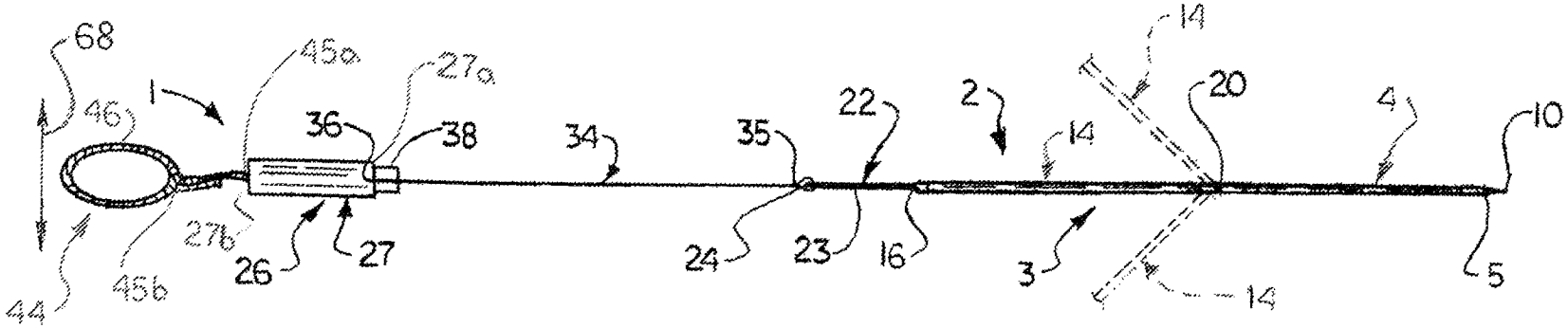
FIG. 2 is a top view of the illustrative firearm stabilizing apparatus illustrated in FIG. 1.
Figure 3:
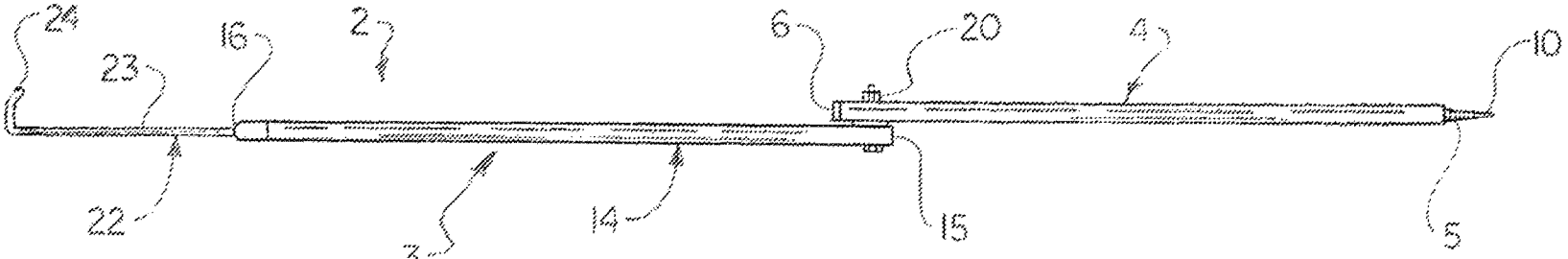
FIG. 3 is a left side view of a typical device mounting assembly having an anchor spike in accordance with the illustrative firearm stabilizing apparatus illustrated in FIG. 1, with the anchor spike deployed in an extended configuration.

As illustrated in FIGS. 1-4, in some embodiments, the device mounting assembly 2 may include an anchor spike 3. The anchor spike 3 may be configured to attach the reel assembly 26 to the support 50 (FIG. 6). In some embodiments, the anchor spike 3 may include a Realtree EZ HANGER® available from www.realtree.com. Accordingly, as illustrated in FIGS. 3 and 4, the anchor spike 3 of the device mounting assembly 2 may include an insertion segment 4. The insertion segment 4 may be configured for attachment to the support 50, typically as will be hereinafter described. An attachment segment 14 may extend from the insertion segment 4. The attachment segment 14 may be configured for attachment to the reel assembly 26, typically as will be hereinafter described. In some embodiments, the attachment segment 14 may be pivotally attached to the insertion segment 4, typically via a pivot fastener 20, to facilitate movement of the reel assembly 26 within the horizontal plane 68, as illustrated in phantom in FIG. 2, when the device mounting assembly 2 is secured to the support 50 for positional aiming adjustment of the firearm 54 within the horizontal plane 68.

Figure 8:
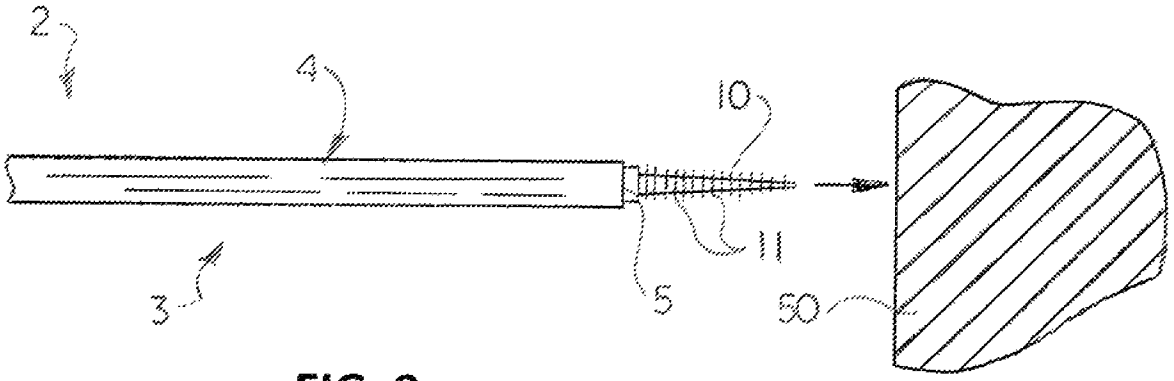
FIG. 8 is an enlarged sectional view of a portion of the anchor spike of the device mounting assembly of the apparatus illustrated in FIG. 1, preparatory to typical insertion of a spike tip on the anchor spike into the support.
Figure 9:
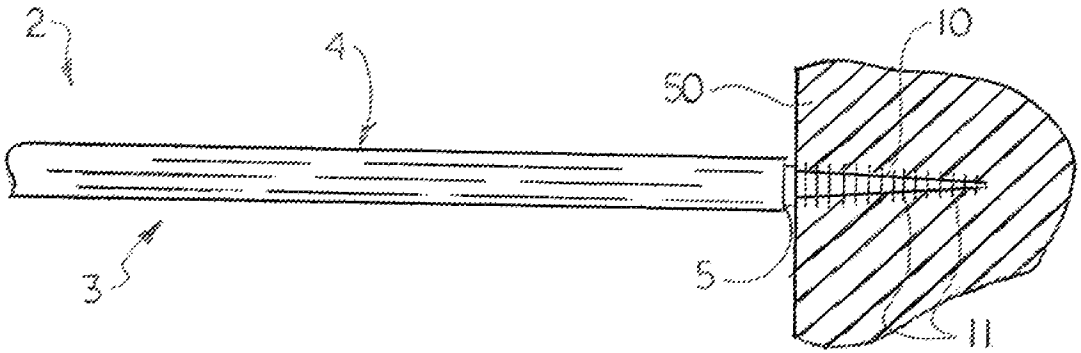
FIG. 9 is an enlarged sectional view of the spike tip of the anchor spike illustrated in FIG. 8, inserted into the support.

The insertion segment 4 of the anchor spike 3 may have a proximal insertion segment end 5 and a distal insertion segment end 6. A sharpened or tapered spike tip 10 may extend from the proximal insertion segment end 5 of the insertion segment 4. As illustrated in FIGS. 8 and 9, the spike tip 10 may be configured for insertion into the support 50 typically by application of manual pressure and rotation of the anchor spike 3. Spike tip threads 11 on the spike tip 10 may anchor the spike tip 10 in the support 50.

The attachment segment 14 may extend beyond the distal insertion segment end 6 of the insertion segment 4. The attachment segment 14 may have a proximal attachment segment end 15 and a distal attachment segment end 16. The proximal attachment segment end 15 of the attachment segment 14 may overlap the distal insertion segment end 6 of the insertion segment 4, with the pivot fastener 20 pivotally attaching the overlapping end portions of the attachment segment 14 and the insertion segment 4. Accordingly, the anchor spike 3 may be selectively deployable in the extended configuration illustrated in FIG. 3 and the folded configuration illustrated in FIG. 4.

A line attachment element 22 may extend from the attachment segment 14. The line attachment element 22 may include a line attachment shaft 23 which extends from the distal attachment segment end 16 of the attachment segment 14. A line attachment hook 24 may be shaped in the distal or extending end of the line attachment shaft 23. Accordingly, the reel assembly 26 may be attached to the anchor spike 3 of the device mounting assembly 2 typically by tying and/or otherwise securing the reel line 34 of the reel assembly 26 to the line attachment hook 24 on the line attachment element 22 of the anchor spike 3.

In some embodiments, the reel assembly 26 of the firearm stabilizing apparatus 1 may be spring-loaded. Accordingly, as illustrated in FIG. 5, the reel assembly 26 may include a reel housing 27 having a reel housing interior 28. A reel handle 38 may be provided on the exterior of the reel housing 27. A reel line opening 29 may extend through the wall of the reel housing 27. A reel spool 30 may be rotatably mounted in the reel housing interior 28. The reel line 34 may be wound on the reel spool 30. The reel line 34 may extend from the reel housing interior 28 through the reel line opening 29. Accordingly, the reel spool 30 may be configured to rotate in a winding direction (the clockwise direction in FIG. 5) to facilitate winding and retraction of the reel line 34 on the reel spool 30 and in an unwinding (counterclockwise) direction to facilitate extension and unwinding of the reel line 34 from the reel spool 30 as the reel line 34 pays out from the reel spool 30 through the reel line opening 29.

As illustrated in FIG. 1, the reel line 34 may have a proximal line end 35 which attaches to the anchor spike 3 of the device mounting assembly 2 and a distal line end 37 (FIG. 5) which may be attached to the reel spool 30 in the reel housing interior 28. The reel line 34 may have an entry point 36 which is between the proximal line end 35 and the distal line end 37 and corresponds to the point of entry of the reel line 34 into the reel housing 27 at the reel line opening 29. As further illustrated in FIG. 1, the entry point 36 may be on a first side 27*a* of the reel housing 27 of the reel assembly 26. The second tether end 45*b* on the reel tether 45 of the reel attachment device 44 may be attached to the reel housing (27) of the eel assembly (26) at a second side 27*b* opposite the first side 27*a* of the reel housing 27.

As illustrated in FIG. 5, a coiled reel spring 31 may engage the reel spool 30. The reel spring 31 may normally bias the reel spool 30 in the winding direction. Accordingly, the reel line 34 may be unwound from the reel spool 30 and extended or paid out from the reel housing 27 through the reel line opening 29 as the reel spool 30 rotates in the unwinding direction against the biasing action of the reel spring 31. Conversely, the reel line 34 may be wound onto the reel spool 30 and retracted into the reel housing 27 by the action of the reel spring 31 as it rotates the reel spool 30 in the winding direction.

In some embodiments, a line lock button 40 may be provided on the reel housing 27 of the reel assembly 26 to selectively configure the reel assembly 26 in the adjustment mode and the locked mode. Accordingly, in the locked mode of the reel assembly 26, the line lock button 40 may be configured to engage the reel spool 30 and/or the reel line 34 to prevent extension or retraction of the reel line 34 with respect to the reel housing interior 28 of the reel housing 27. In the adjustment mode of the reel assembly 26, the line lock button 40 may be configured to disengage the reel spool 30 and/or the reel line 34 to facilitate extension or retraction of the reel line 34 as the length of the reel line 34 between the proximal line end 35 and the entry point 36 increases or decreases, respectively.

In typical application of the firearm stabilizing apparatus 1, the anchor spike 3 of the device mounting assembly 2 may be attached to the support 50. This may be accomplished by initially deploying the anchor spike 3 from the folded configuration (FIG. 4) to the extended configuration (FIG. 3). The spike tip 10 on the proximal insertion segment end 5 of the insertion segment 4 may then be inserted or screwed into the support 50 typically by simultaneously applying directional pressure of the spike tip 10 against the surface of the support 50, as illustrated in FIG. 8, while rotating the anchor spike 3 such that the spike tip threads 11 on the spike tip 10 engage the interior of the support 50, as illustrated in FIG. 9.

The proximal line end 35 of the reel line 34 may be attached to the line attachment element 22 on the anchor spike 3 of the device mounting assembly 2. The reel line 34 may be extended from the reel housing 27 of the reel assembly 26, and the reel attachment device 44 attached to the firearm 54. In some applications, the tether loop 46 on the reel tether 45 of the reel attachment device 44 may be extended around the scope 58 on the firearm 54, as illustrated in FIG. 6.

The line lock button 40 (FIG. 5) on the reel housing 27 of the reel assembly 26 may be manipulated to deploy the reel assembly 26 in the adjustment mode. Accordingly, subsequent to grasping the firearm 54, as illustrated in FIG. 6, the shooter 62 may sight a target which the shooter desires to shoot. The shooter 62 may thus adjust the vertical aiming position of the firearm 54 within the vertical plane 66 (FIG. 7) to accord with the vertical position of the target. When the firearm 54 has reached the desired vertical aiming position, the shooter 62 may manipulate the line lock button 40 from the adjustment mode to the lock mode. The reel assembly 26 may thus prevent further movement of the firearm 54 within the vertical plane 66 to stabilize the firearm 54 at the selected vertical aiming position. The device mounting assembly 2 may simultaneously facilitate horizontal adjustment in the aiming position of the firearm 54 within the horizontal plane 68 (FIG. 2). Accordingly, the shooter 62 may aim the firearm 54 at the desired target and achieve an accurate shot since the firearm stabilizing apparatus 1 prevents inadvertent or unsteady movement of the firearm 54 within the vertical plane 66 as the shooter 62 aims and fires the firearm 54. After use, the firearm 54 may be detached from the reel assembly 26, the reel line 34 detached from the anchor spike 3 of the device mounting assembly 2 and the anchor spike 3 unscrewed from the support 50.

Referring next to FIGS. 10-13 of the drawings, an alternative illustrative embodiment of the firearm stabilizing apparatuses is generally indicated by reference numeral 101. Unless otherwise noted, in the firearm stabilizing assembly 101, elements which are structurally and/or functionally analogous to the respective elements of the firearm stabilizing assembly 1 that was heretofore described with respect to FIGS. 1-9 are designated by the same respective numerals in the 101-199 series in FIGS. 10-13.

Figure 13:
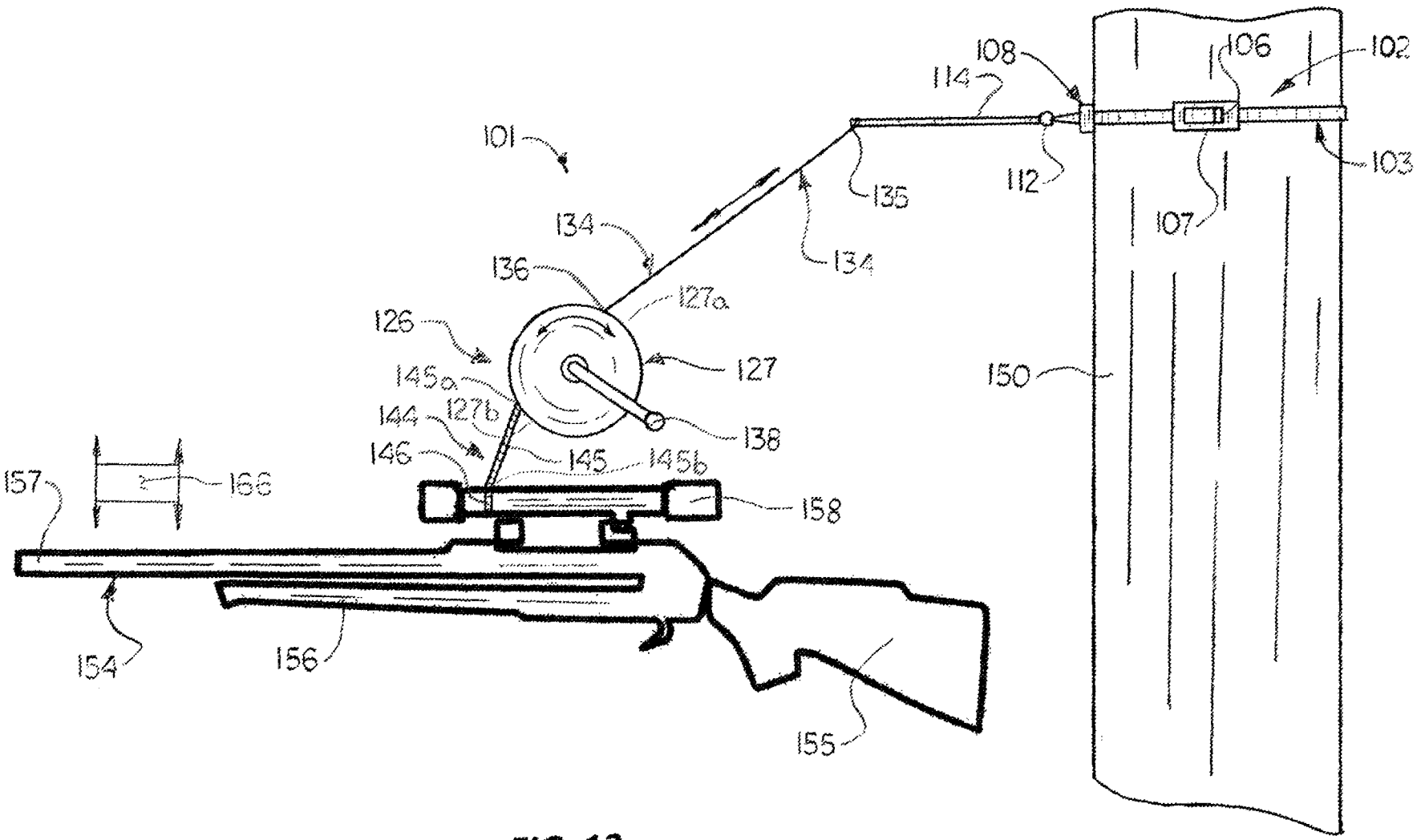
FIG. 13 is a left side view of the illustrative firearm stabilizing apparatus illustrated in FIG. 10, attached to a support (illustrated in phantom), more particularly illustrating typical vertical aiming position adjustment of the firearm in typical application of the firearm stabilizing apparatus.

The device mounting assembly 102 of the firearm stabilizing assembly 101 may include at least one anchor strap 103. The anchor strap 103 may be suitably configured for securement around the support 150 (FIG. 13). A reel attachment frame 108 may be supported by the anchor strap 103. The reel assembly 126 may be supported by the reel attachment frame 108 of the device mount assembly 102, typically as will be hereinafter described.

Figure 10:
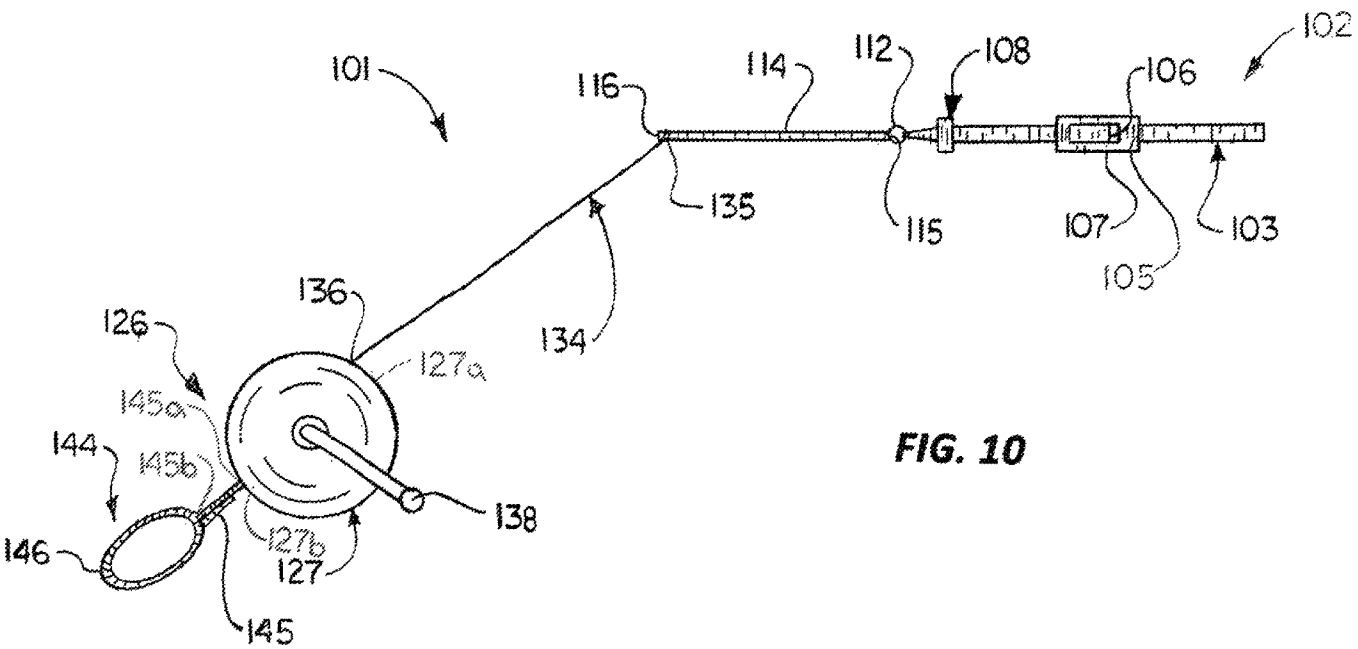
FIG. 10 is a left side view of an alternative illustrative embodiment of the firearm stabilizing apparatuses of the disclosure.
Figure 11:
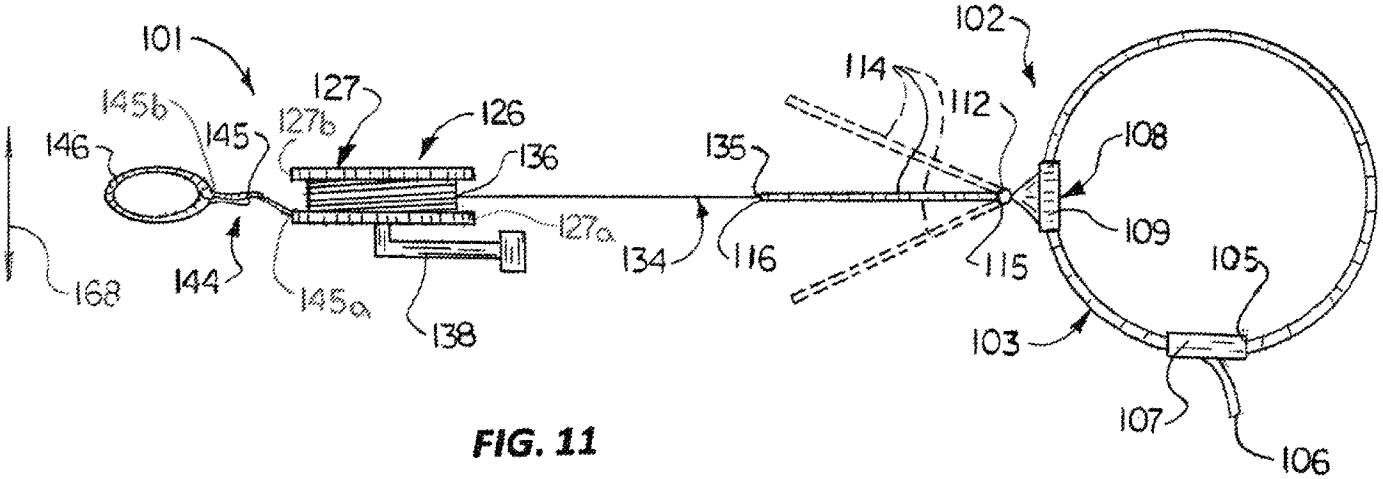
FIG. 11 is a top view of the illustrative firearm stabilizing apparatus illustrated in FIG. 10.

As illustrated in FIGS. 10 and 11, the anchor strap 103 of the device mounting assembly 102 may have a buckle strap end 105 and an insertion end 106. A strap buckle 107 may be provided at the buckle strap end 105 of the anchor strap 103. The strap buckle 107 may be configured to engage the insertion end 106 to secure the anchor strap 103 in a secured configuration around the support 150 in typical application of the firearm stabilizing apparatus 101, which will be hereinafter described. The strap buckle 107 may include a quick disconnect buckle or any other type of buckle which is suitable for the purpose of selectively deploying the anchor strap 103 in the secured configuration and releasing the anchor strap 103.

An elongated frame arm 114 may extend from the reel attachment frame 108 of the device mount assembly 102. The reel line 134 of the reel assembly 126 may be configured for attachment to the frame arm 114, typically as will be hereinafter described. A swivel connector 112 may be supported by the reel attachment frame 108 of the device mounting assembly 102. The frame arm 114 may extend from the swivel connector 112 such that the swivel connector 112 facilitates positional adjustment of the frame arm 114 and the reel line 134 and reel assembly 126 attached thereto, as well as the firearm 154 attached to the reel assembly 126, within the horizontal plane 168. Accordingly, as illustrated in phantom in FIG. 11, the pivotal movement of the frame arm 114 within the horizontal plane 168 may facilitate horizontal aiming adjustment of the firearm 154 in typical application of the firearm stabilizing apparatus 101, which will be hereinafter described.

Figure 12:
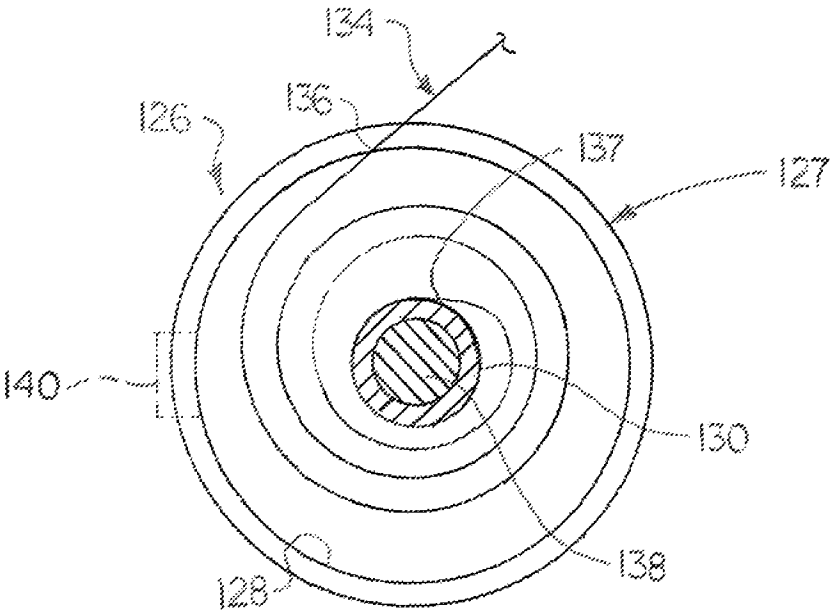
FIG. 12 is a sectional view illustrating typical interior components of an illustrative reel assembly of the firearm stabilizing apparatus illustrated in FIG. 10.

In some embodiments, the reel assembly 126 may be spring-loaded and may have a design which is the same as or similar to that of the reel assembly 26 of the firearm stabilizing apparatus 1 heretofore described with respect to FIGS. 1-9. In some embodiments, the reel assembly 126 may be crank-operated and may include a reel housing 127 with a reel housing interior 128, as illustrated in FIG. 12. A reel spool 130 may be rotatably disposed in the reel housing interior 128. The reel line 134 may be wound on the reel spool 130. As illustrated in FIG. 13, the reel line 134 may have a proximal line end 135 which attaches to the swivel connector 112 of the device mounting assembly 102, a distal line end 137 (FIG. 12) which may be attached to the reel spool 130 in the reel housing interior 128, and an entry point 136 which is between the proximal line end 135 and the distal line end 137 and corresponds to the point of entry of the reel line 134 into the reel housing 127.

A hand-operated hand crank 138 may engage the reel spool 130 to facilitate manual rotation of the reel spool 130 in the reel housing interior 128 of the reel housing 127. Accordingly, the hand crank 138 may be rotated in the counterclockwise direction in FIG. 12 to rotate the reel spool 130 in the winding direction and facilitate winding of the reel line 134 on the reel spool 130 and retraction of the reel line 134 into the reel housing 127. The reel spool 130 may be rotated in the opposite, typically clockwise direction in FIG. 12 to facilitate extension and unwinding of the reel line 134 from the reel spool 130 as the reel line 134 pays out from the reel spool 130 and extends from the reel housing 127.

As illustrated in phantom in FIG. 12, in some embodiments, a line lock button 140 may be provided on the reel housing 127 of the reel assembly 126 to selectively configure the reel assembly 126 in the adjustment mode and the locked mode. Accordingly, in the locked mode of the reel assembly 126, the line lock button 140 may be configured to engage the reel spool 130 and/or the reel line 134 to prevent extension or retraction of the reel line 134 with respect to the reel housing interior 128 of the reel housing 127. In the adjustment mode of the reel assembly 126, the line lock button 140 may be configured to disengage the reel spool 130 and/or the reel line 134 to facilitate extension or retraction of the reel line 134 as the length of the reel line 134 between the proximal line end 135 and the entry point 136 increases or decreases, respectively.

A reel attachment device 144 may be provided on the reel housing 127 of the reel assembly 126. The reel attachment device 144 may facilitate attachment of the reel assembly 126 to the firearm 154. In some embodiments, the reel attachment device 144 may include the reel tether 145 which may be attached to the reel housing 127 of the reel assembly 126 and the tether loop 146 which terminates the reel tether 145 and is configured to engage the scope 158, as illustrated, or the forestock 156, the barrel 157, and/or other component of the firearm 154. In other embodiments, the reel attachment device 144 may have alternative designs suitable for the purpose.

In typical application of the firearm stabilizing apparatus 101, the anchor strap 103 of the device mounting assembly 102 may be attached to the support 150. This may be accomplished by extending the anchor strap 103 around the support 150 and fastening the anchor strap 103 using the strap buckle 107.

The proximal line end 135 of the reel line 134 may be attached to the frame arm 114 of the device mounting assembly 102. The reel line 134 may be extended from the reel housing 127 of the reel assembly 126, typically by rotation of the hand crank 138 in the unwinding direction, and the reel attachment device 144 attached to the firearm 154.

The line lock button 140 (FIG. 12) on the reel housing 127 of the reel assembly 126 may be manipulated to initially deploy the reel assembly 126 in the adjustment mode. Accordingly, subsequent to grasping the firearm 154, as was heretofore described with respect to FIG. 6, the shooter 62 (FIG. 6) may sight a target which the shooter desires to shoot. The shooter 62 may thus adjust the vertical aiming position of the firearm 154 within the vertical plane 166 (FIG. 13) to accord with the vertical position of the target. When the firearm 154 has reached the desired vertical aiming position, the shooter 62 may manipulate the line lock button 140 from the adjustment mode to the lock mode. The reel assembly 126 may thus prevent further movement of the firearm 154 within the vertical plane 166 to stabilize the firearm 154 at the selected vertical aiming position. The device mounting assembly 102 may simultaneously facilitate horizontal adjustment in the aiming position of the firearm 154 within the horizontal plane 168 (FIG. 11). Accordingly, the shooter 62 may aim the firearm 154 at the desired target and achieve an accurate shot since the firearm stabilizing apparatus 101 prevents inadvertent or unsteady movement of the firearm 154 within the vertical plane 166 as the shooter 62 aims and fires the firearm 154. After use, the firearm 154 may be detached from the reel assembly 126, the reel line 134 detached from the frame arm 114 of the device mounting assembly 102 and the anchor strap 103 unfastened at the strap buckle 107 and removed from the support 150.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A firearm stabilizing apparatus suitable for securement to a support to stabilize a firearm in a selected vertical aiming position while facilitating horizontal aim positioning of the firearm, the firearm stabilizing apparatus comprising:

a device mounting assembly configured for securement to the support;

a reel assembly supported by the device mounting assembly and configured for attachment to the firearm, the reel assembly comprising:

a reel housing;

a rotatable reel spool in the reel housing;

a reel line configurable for extension and retraction within a vertical plane, the reel line wound on the reel spool and having a proximal line end attachable to the device mounting assembly and a distal line end attached to the reel spool; and an entry point between the proximal line end and the distal line end of the reel line, the entry point corresponding to a point of entry of the reel line into the reel housing on a first side of the reel housing;

a reel attachment device comprising:

a reel tether having a first tether end attached to the reel housing of the reel assembly at a second side opposite the first side of the reel housing and a second tether end opposite the first tether end, the second tether end configured for attachment to the firearm;

the device mounting assembly configured to facilitate movement of the reel assembly within a horizontal plane when the device mounting assembly is secured to the support; and the reel assembly selectively configurable in an adjustment mode and a locked mode, the reel assembly configured to selectively facilitate positional adjustment of the firearm within the vertical plane in the adjustment mode and securement of the firearm at a selected position within the vertical plane in the locked mode of the reel assembly when the device mounting assembly is secured to the support.

2. The firearm stabilizing apparatus of claim 1 wherein the reel tether comprises a tether loop at the second tether end, the tether loop configured for receiving the firearm.

3. The firearm stabilizing apparatus of claim 1 wherein the device mounting assembly comprises an anchor spike configured for attachment to the support.

4. The firearm stabilizing apparatus of claim 1 wherein the device mounting assembly comprises an anchor strap and a reel attachment frame supported by the anchor strap, and wherein the reel assembly is supported by the reel attachment frame.

5. The firearm stabilizing apparatus of claim 1 wherein the reel assembly comprises a spring-loaded reel assembly.

6. The firearm stabilizing apparatus of claim 1 wherein the reel assembly comprises a crank-operated reel assembly.

7. A firearm stabilizing apparatus suitable for securement to a support to stabilize a firearm in a selected vertical aiming position while facilitating horizontal aim positioning of the firearm, the firearm stabilizing apparatus comprising:

a device mounting assembly comprising an anchor spike configured for securement to the support;

a reel assembly comprising:

a reel housing;

a rotatable reel spool in the reel housing;

a reel line configurable for extension and retraction within a vertical plane, the reel line of the reel assembly wound on the reel spool and having a proximal line end attachable to the anchor spike of the device mounting assembly and a distal line end attached to the reel spool; and an entry point between the proximal line end and the distal line end of the reel line, the entry pint corresponding to a point of entry of the reel line into the reel housing on a first side of the reel housing;

a reel attachment device on the reel assembly, the reel attachment device configured for attachment to the firearm and comprising:

a reel tether having a first tether end attached to the reel housing of the reel assembly at a second side opposite the first side of the reel housing and a second tether end opposite the first tether end, the second tether end configured for attachment to the firearm;

the anchor spike of the device mounting assembly configured to facilitate movement of the reel assembly within a horizontal plane when the device mounting assembly is secured to the support; and the reel assembly selectively configurable to facilitate extension and retraction of the reel line in an adjustment mode of the reel assembly and prevent extension and retraction of the reel line a locked mode of the reel assembly, the reel assembly configured to selectively facilitate positional adjustment of the firearm within the vertical plane in the adjustment mode and securement of the firearm at a selected position within the vertical plane in the locked mode of the reel assembly when the device mounting assembly is secured to the support.

8. The firearm stabilizing apparatus of claim 7 wherein the reel tether comprises a tether loop at the second tether end, the tether loop configured for receiving the firearm.

9. The firearm stabilizing apparatus of claim 7 wherein the anchor spike of the device mounting assembly comprises an insertion segment configured for engaging the support and an attachment segment pivotally supported by the insertion segment, the attachment segment configured for attachment to the reel line of the reel assembly.

10. The firearm stabilizing apparatus of claim 7 further comprising a reel spring engaging the reel spool.

11. The firearm stabilizing apparatus of claim 7 further comprising a line lock button on the reel housing, the line lock button configured to selectively deploy the reel line in the adjustment mode and the locked mode.

12. A firearm stabilizing apparatus suitable for securement to a support to stabilize a firearm in a selected vertical aiming position while facilitating horizontal aim positioning of the firearm, the firearm stabilizing apparatus comprising:

a device mounting assembly comprising:

an anchor strap configured for securement to the support;

a reel attachment frame supported by the anchor strap; and a swivel connector supported by the reel attachment frame;

a reel assembly comprising:

a reel housing;

a rotatable reel spool in the reel housing;

a reel line configurable for extension and retraction within a vertical plane, the reel line of the reel assembly wound on the reel spool and having a proximal line end attachable to the swivel connector of the device mounting assembly and a distal line end attached to the reel spool, the swivel connector facilitating positional adjustment of the reel line within a horizontal plane; and an entry point between the proximal line end and the distal line end of the reel line, the entry point corresponding to a point of entry of the reel line into the reel housing on a first side of the reel housing;

a reel attachment device on the reel assembly, the reel attachment device configured for attachment to the firearm and comprising:

a reel tether having a first tether end attached to the reel housing of the reel assembly at a second side opposite the first side of the reel housing and a second tether end opposite the first tether end, the second tether end configured for attachment to the firearm; and the reel assembly selectively configurable to facilitate extension and retraction of the reel line in an adjustment mode of the reel assembly and prevent extension and retraction of the reel line a locked mode of the reel assembly, the reel assembly configured to selectively facilitate positional adjustment of the firearm within the vertical plane in the adjustment mode and securement of the firearm at a selected position within the vertical plane in the locked mode of the reel assembly when the device mounting assembly is secured to the support.

13. The firearm stabilizing apparatus of claim 12 wherein the reel tether comprises a tether loop at the second tether end, the tether loop configured for receiving the firearm.

14. The firearm stabilizing apparatus of claim 12 wherein the reel attachment frame of the device mounting assembly comprises a frame base supported by the anchor strap and the swivel connector is supported by the frame base, and further comprising a frame arm extending from the swivel connector and positionally adjustable within the horizontal plane, and wherein the reel line of the reel assembly is attachable to the frame arm.

15. The firearm stabilizing assembly of claim 12 further comprising a hand crank engaging the reel spool.

16. The firearm stabilizing apparatus of claim 12 further comprising a line lock button on the reel housing, the line lock button configured to selectively deploy the reel line in the adjustment mode and the locked mode of the reel assembly.

* * * * *